United States Patent [19]

Danieli

[11] 3,944,116

[45] Mar. 16, 1976

[54] PROCESS AND DEVICE FOR AIDING IN OPENING THE TUNDISH NOZZLE IN A CONTINUOUS CASTING SYSTEM

[76] Inventor: Luigi Danieli, Buttrio, Italy

[22] Filed: Apr. 1, 1974

[21] Appl. No.: 456,610

Related U.S. Application Data

[63] Continuation of Ser. No. 307,978, Nov. 20, 1972, abandoned.

[30] Foreign Application Priority Data

May 5, 1972 Italy ..... 23956/72

[52] U.S. Cl. ..... 222/1; 222/563; 266/38; 266/42

[51] Int. Cl.[2] ..... B22D 37/00; B22D 41/10

[58] Field of Search ..... 266/38, 42; 222/1, 563, 222/DIG. 3, DIG. 23, 148, 151; 164/281, 337, 274

[56] References Cited

UNITED STATES PATENTS

| | | | |
|---|---|---|---|
| 1,286,632 | 12/1918 | Hodge | 266/38 |
| 1,797,566 | 3/1931 | Brown | 266/42 |
| 2,328,267 | 8/1943 | Freeman | 222/563 X |
| 3,511,261 | 5/1970 | Bick et al. | 222/1 UX |
| 3,525,381 | 8/1970 | Leese et al. | 164/274 |

FOREIGN PATENTS OR APPLICATIONS

| | | | |
|---|---|---|---|
| 563,076 | 12/1957 | Belgium | 222/563 UX |

OTHER PUBLICATIONS

Harbison–Welker Refractories Company, *Modern Refractory Practice*, Pittsburgh, Penn., 1961, pp. 282–284.

*Primary Examiner*—Robert B. Reeves
*Assistant Examiner*—David A. Scherbel
*Attorney, Agent, or Firm*—Woodling, Krost, Granger & Rust

[57] ABSTRACT

The present invention discloses a process of closing a nozzle hole in the bottom of a tundish, which is used in pouring molten steel. The tundish has a bottom, which is generally funnel-shaped and, also, has wall means which define the nozzle hole. The steps of the process comprise placing a closure in the nozzle hole to close the same and then placing a finely divided chrome compound on top of the closure and into the nozzle hole and in an amount to at least partially fill the bottom of the tundish. The chrome compound has a sintering temperature of on the order of at least 1740° C. The closure is provided by inserting a rolled up and pressed asbestos bead into the nozzle hole with an end of the bead extending out of the nozzle hole in a position to be grasped by a workman. The tundish of the present invention is operated by pouring molten steel into the tundish and on top of the finely divided chrome compound, which resides on top of the closure. When it is desired to remove the steel from the tundish the closure is removed from the nozzle hole by an operator grasping and pulling out the asbestos bead, which permits the finely divided chrome compound and the molten steel to flow from the nozzle hole.

3 Claims, 1 Drawing Figure

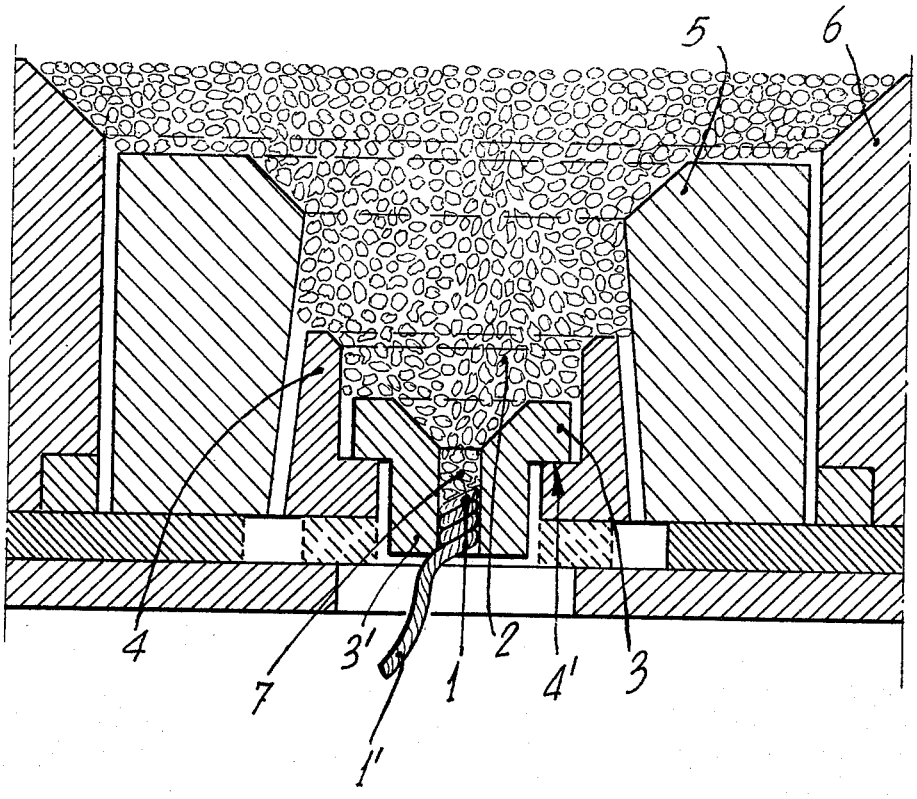
5
6
4
7
3'
1
2
4'
3
1'

PROCESS AND DEVICE FOR AIDING IN OPENING THE TUNDISH NOZZLE IN A CONTINUOUS CASTING SYSTEM

This application is a continuation of U.S. patent application Ser. No. 307,978 filed Nov. 20, 1972, now abandoned.

This invention relates to a process and associated device for aiding in opening the tundish nozzle in a continuous casting system as designed to obviate the casual obstruction of the tundish nozzle casting gate, obstruction which is due to slags, refractories and cold steel splashes. Such a device consists of inserting in the tundish nozzle gate some amount of chrome sand, which is held in place by a rolled up asbestos bead pressure applied externally of the tundish, leaving a short length outwardly hanging down which is for gripping purposes in opening the tundish, when desired.

In modern continuous casting steel production plants, some drawbacks occur as due to the problems built up by the tundish clogging. At the casting beginning such a clogging, always of a casual nature, is determined because of slags, refractories and also cold steel splashes. Thus, in addition to unavoidably carrying slags and refractories, upon reaching the tundish a molten steel will produce on dropping on the tundish refractory splashes which become solidified by spattering. Along with slags and refractories, such splashes will unavoidably insert in the tundish duct and clog the same. Such a clogging will partially or even totally stop the working line or schedule and, hence, the production, with all of the accompanying disadvantages and damages. In this case it would be quite necessary to use oxygen for removing the tundish clogging, which is always objectionable for the damages caused to refractories and steel as well.

The accompanying drawing is an axial vertical sectional view showing the bottom portion of a tundish.

The process for aiding in opening the tundish in a continuous casting system essentially consists of carrying out the following operations.

Prior to filling the tundish 6 with molten steel, and thus just at preheating step completion, as asbestos plug 1 is applied externally of the tundish 6 at the cylindrical portion 3' of the tundish nozzle 3, which includes a nozzle hole this asbestos plug 1 comprising a rolled up bead which is pressured inserted from outside, leaving one end 1' downward extending. Then, some amount of chrome sand 2 is poured at the nozzle in said tundish 6 to obtain the level of refractories 5. This chrome sand 2, the sinterizing point of which is 1740°C, is quite suitable to endure both the heat and weight of the molten steel and, by partly occupying the cylindrical gate 7 of the tundish nozzle 3, will concurrently prevent slags, refractories and cold splashes from inserting therein. Therefore, the slags and refractories will be caused to float in the molten steel bath by rising and the cold splashes will be melted again and thus removed.

Whereupon, the tundish 6 is filled with molten steel for casting beginning, it being then sufficient to remove from below the asbestos plug 1 by pulling the bead tail or end 1' comprising it. The gate 7 opens and first the chrome sand issues, followed by the steel flow. Should the latter not sufficiently flow, then slight strikes would be given by a hammer or the like to the outer wall of the tundish to cause the chrome sand 2 to rapidly issue. First the red-hot sand and then the molten steel will readily issue from the tundish nozzle 3 as maintained clear up to that time. Said tundish nozzle 3 is supported by means of a tundish nozzle carrier 4 provided with a step 4' for the support of the tundish nozzle shoulders. The nozzle 3 and the carrier 4 form what may be referred to as a funnel-shaped bottom of the tundish. The chrome sand fills the top end of the cylindrical tundish nozzle portion and the other spaces up to the level of the refractories 5 in the casting tundish base. The use of the chrome sand is particularly advantageous because of its high sinterizing point, suitable to endure both the high heat and high pressure.

What is claimed is:

1. The process of closing a nozzle hole in the bottom of a tundish used in pouring molten steel, comprising the steps of inserting a rolled up and pressed asbestos bead into the nozzle hole with an end of the bead extending out of the nozzle hole in a position to be grasped by an operator, applying a finely divided chrome compound into the nozzle hole adjacent the closure and at least partially filling the bottom of the tundish, said chrome compound having a sintering temperature of on the order of at least 1740° C.

2. In a tundish for use in pouring molten steel having a funnel-shaped bottom and wall means defining a nozzle hole providing an exit from the bottom, the provision in said nozzle hole of a rolled up and pressed asbestos bead forming a closure for said nozzle and having an end which extends out of said nozzle hole and a finely divided chrome compound filling the nozzle hole adjacent the closure and at least a portion of the funnel-shaped bottom, said chrome compound having a sintering temperature of on the order of at least 1740° C.

3. The process of operating a tundish having a nozzle hole in the bottom thereof including the steps of inserting a rolled up and pressed asbestos bead into said nozzle hole so an end of said bead extends out of said nozzle hole, placing a finely divided chrome compound on top of the closure formed by the asbestos bead and into the nozzle hole and at least partially filling the bottom of the tundish, said chrome compound having a sintering temperature of on the order of at least 1740° C, pouring molten steel into the tundish and on top of the finely divided chrome compound, removing the bead from the nozzle hole by grasping its extended end and pulling it to permit the finely divided chrome compound and molten steel to flow from the nozzle hole.

* * * * *